US008096210B2

(12) United States Patent
Sawyer et al.

(10) Patent No.: US 8,096,210 B2
(45) Date of Patent: Jan. 17, 2012

(54) BOLT HOLDER TOOL

(75) Inventors: George M. Sawyer, Norwich, CT (US); John M. Barber, Moodus, CT (US); Robet T. Badin, Rockfall, CT (US); Sean M. Clancy, East Hartford, CT (US); Jeffery R. McQuarrie, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 199 days.

(21) Appl. No.: 12/426,270

(22) Filed: Apr. 19, 2009

(65) Prior Publication Data

US 2010/0263497 A1 Oct. 21, 2010

(51) Int. Cl.
*B25B 13/48* (2006.01)
*B25B 13/06* (2006.01)

(52) U.S. Cl. ..... 81/57.36; 81/55; 81/124.4

(58) Field of Classification Search ..... 81/57.36, 81/57.22, 13, 57.16, 57.35, 57.4, 124.4, 55
See application file for complete search history.

(56) References Cited

U.S. PATENT DOCUMENTS 1,544,847 A * 7/1925 Mason ..... 81/57.35
1,785,125 A * 12/1930 Kalo ..... 81/57.16
2,069,882 A * 2/1937 Hall ..... 81/57.22
4,387,611 A * 6/1983 Junkers ..... 81/57.36
4,516,445 A * 5/1985 Wlodarski ..... 81/57.36
4,979,872 A 12/1990 Myers et al.
5,163,816 A 11/1992 Goetzke et al.
5,220,784 A 6/1993 Wilcox
5,537,814 A 7/1996 Nastuk et al.
5,628,621 A 5/1997 Toborg
5,961,246 A 10/1999 Mitsubori
6,276,124 B1 8/2001 Soh et al.
6,481,917 B1 11/2002 Chen et al.
6,481,970 B2 11/2002 Mukherjee et al.
6,503,021 B2 * 1/2003 Corbetta ..... 81/57.36
6,663,343 B1 12/2003 Anderson
6,663,530 B2 12/2003 Poulin et al.
6,976,827 B2 12/2005 Bruno et al.
7,055,303 B2 6/2006 Macfarlane et al.
7,124,857 B2 10/2006 Gekht et al.
7,147,436 B2 12/2006 Suciu et al.
7,223,197 B2 5/2007 Poulin et al.
7,266,941 B2 9/2007 Eleftheriou et al.
7,306,432 B2 12/2007 Rockarts et al.
7,370,467 B2 5/2008 Eleftheriou et al.
7,370,787 B2 5/2008 Bacon et al.
7,452,188 B2 11/2008 Bouchard
7,455,150 B1 11/2008 Gekht et al.
7,836,796 B2 * 11/2010 Chang ..... 81/57.22

* cited by examiner

*Primary Examiner* — Hadi Shakeri
(74) *Attorney, Agent, or Firm* — Carlson Gaskey & Olds P.C.

(57) ABSTRACT

A tool includes a base ring which defines a multiple of bores, each of the multiple of bores sized to receive one of a multiple of socket assemblies. A slide ring mountable to the base ring to rotate the multiple of socket assemblies.

11 Claims, 4 Drawing Sheets

BOLT HOLDER TOOL

BACKGROUND

The present disclosure relates to tools, and more particularly to a tool which holds a multiple of bolts for torque application yet provides for effortless release.

Bolts such as tie-bolts are often used in aerospace systems such as a gas turbine engine to secure components. Oftentimes a multiple of tie-bolts are required to receive torque at one time.

The application of torque to the multiple of tie-bolts is facilitated by a tool which holds the tie-bolts against the torque application. Although effective, conventional tools may lock-up on the tie-bolts due to the combined application of torque such that the tool becomes difficult to remove after torque application. In some cases, slide hammers are required to disengage the tool.

SUMMARY

A tool according to an exemplary aspect of the present disclosure includes a base ring which defines a multiple of bores, each of the multiple of bores sized to receive one of a multiple of socket assemblies. A slide ring mountable to the base ring to at least partially rotate the multiple of socket assemblies.

A method of torquing a multiple of bolts arranged in a circular pattern according to an exemplary aspect of the present disclosure includes locating each of a multiple of socket assemblies on each of a multiple of bolts, the multiple of socket assemblies arranged for rotation within a base ring. Mounting a slide ring to the base ring to at least partially rotate the multiple of socket assemblies. Torqing the bolts.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
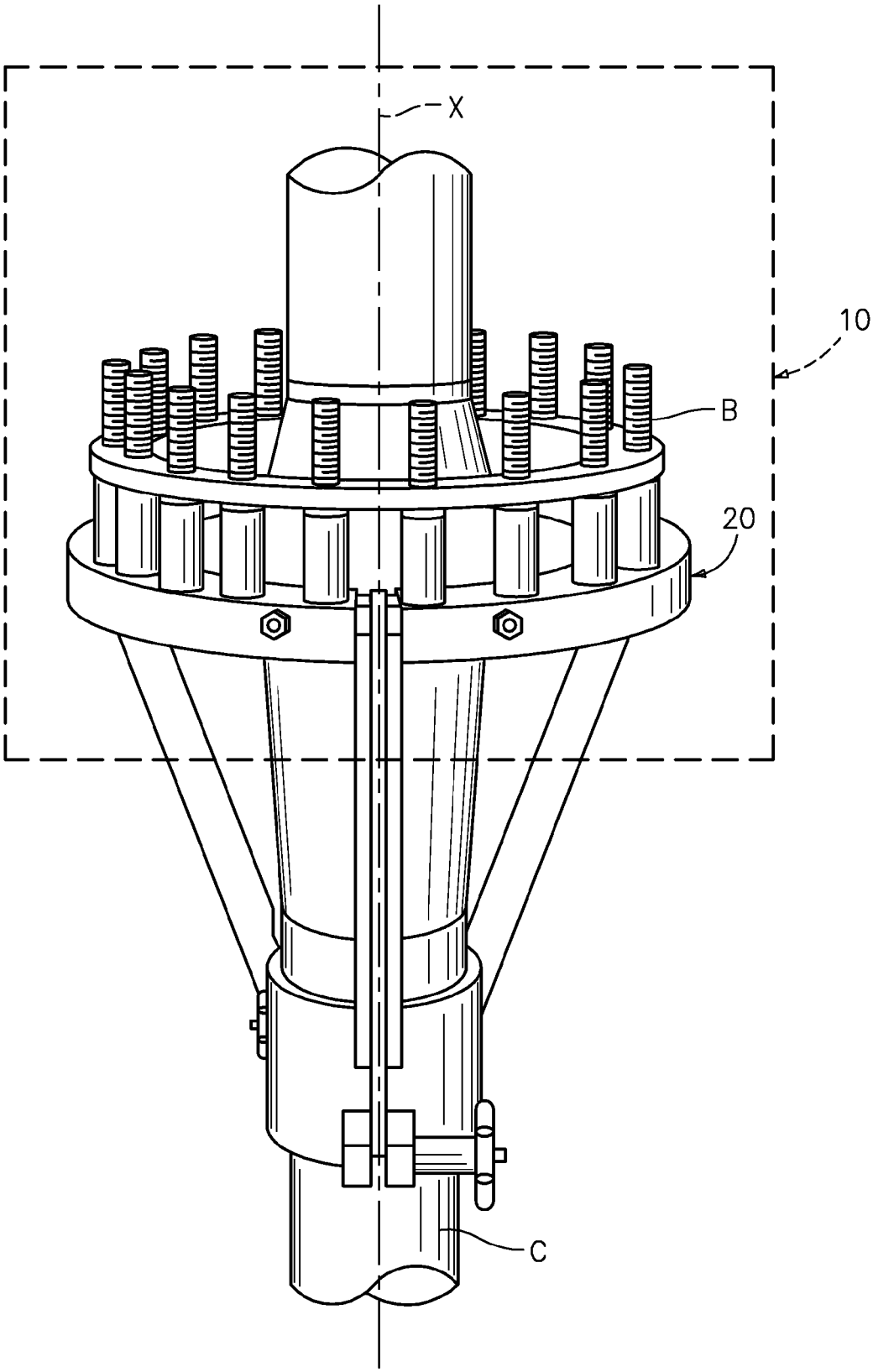
FIG. 1 is a general perspective view of a tool mounted to a component with a multiple of tie-bolts arranged in a generally circular pattern.

Referring to FIG. 1, a component C such as a shaft or case structure within a gas turbine engine 10 (illustrated schematically) may include a multiple of tie-bolts B which are defined about axis X and arranged in a generally circular pattern. During assembly for example, the tie-bolts B receive an application of torque. The torque application is facilitated by a tool 20 which holds the tie-bolts B against rotation during the torque application. Although the tool 20 is described herein with reference to a gas turbine engine, it should be understood that an appropriated sized tool may be utilized to facilitate attachment of a multiple of bolts to various components generally in accords to that disclosed herein.

Figure 2:
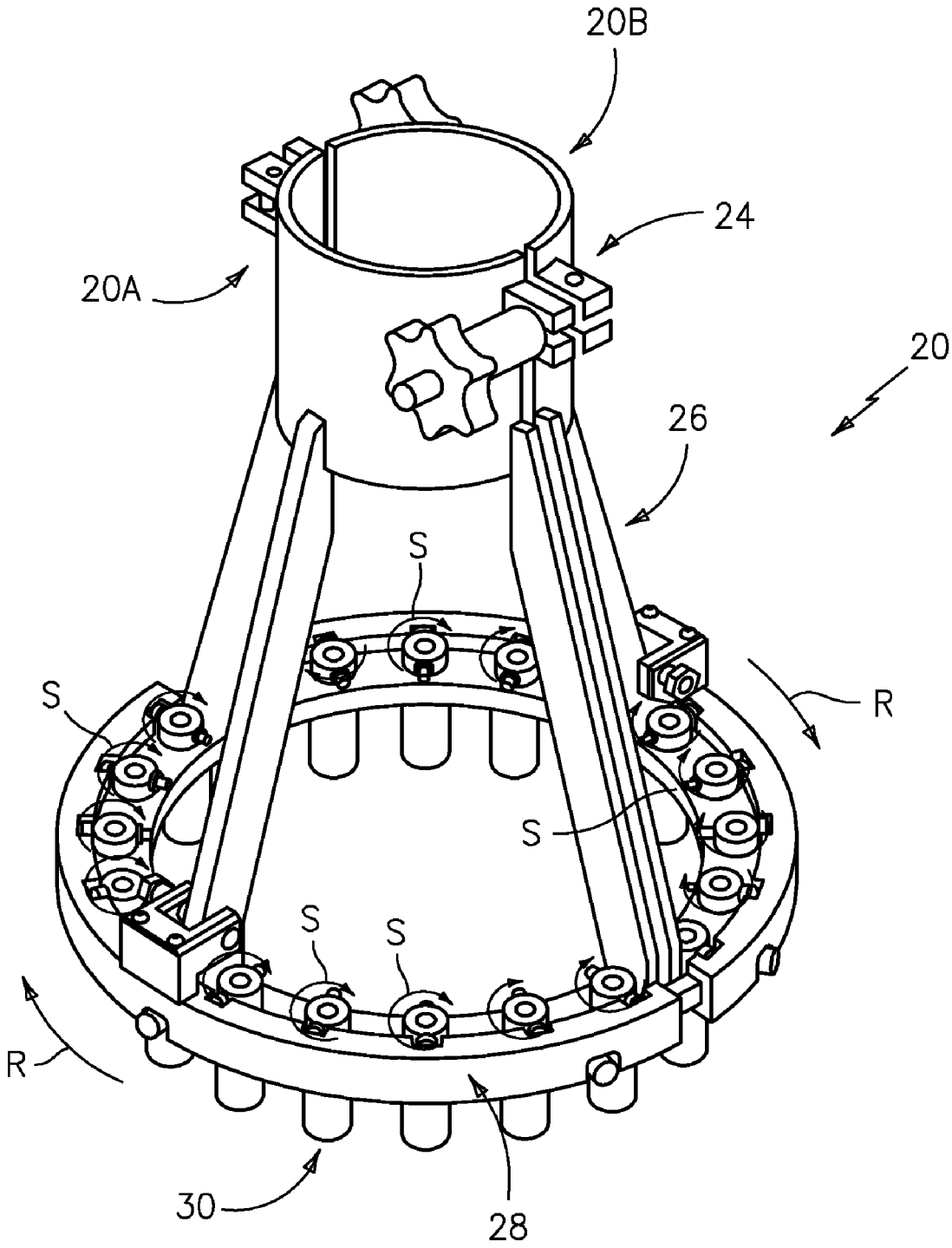
FIG. 2 is a perspective view of a tool according to one non-limiting embodiment of the disclosure.

Referring to FIG. 2, the tool 20 generally includes a base ring 22 mounted to a support 24 by a multiple of arms 26 (six shown), a slide ring 28 and a multiple of socket assemblies 30. The tool 20 generally includes two semi-circular tool sections 20A, 20B defined along an axis A to facilitate attachment around the shaft C or other component which includes a multiple of circumferentially distributed tie-bolts B (FIG. 1). Whereas each tool section 20A, 20B is generally alike, only section 20A will be describe in detail herein. It should be understood that although two sections are described in the disclosed non-limiting embodiment other semi-circular sections may be utilized such as, for example, four sections.

Figure 3:
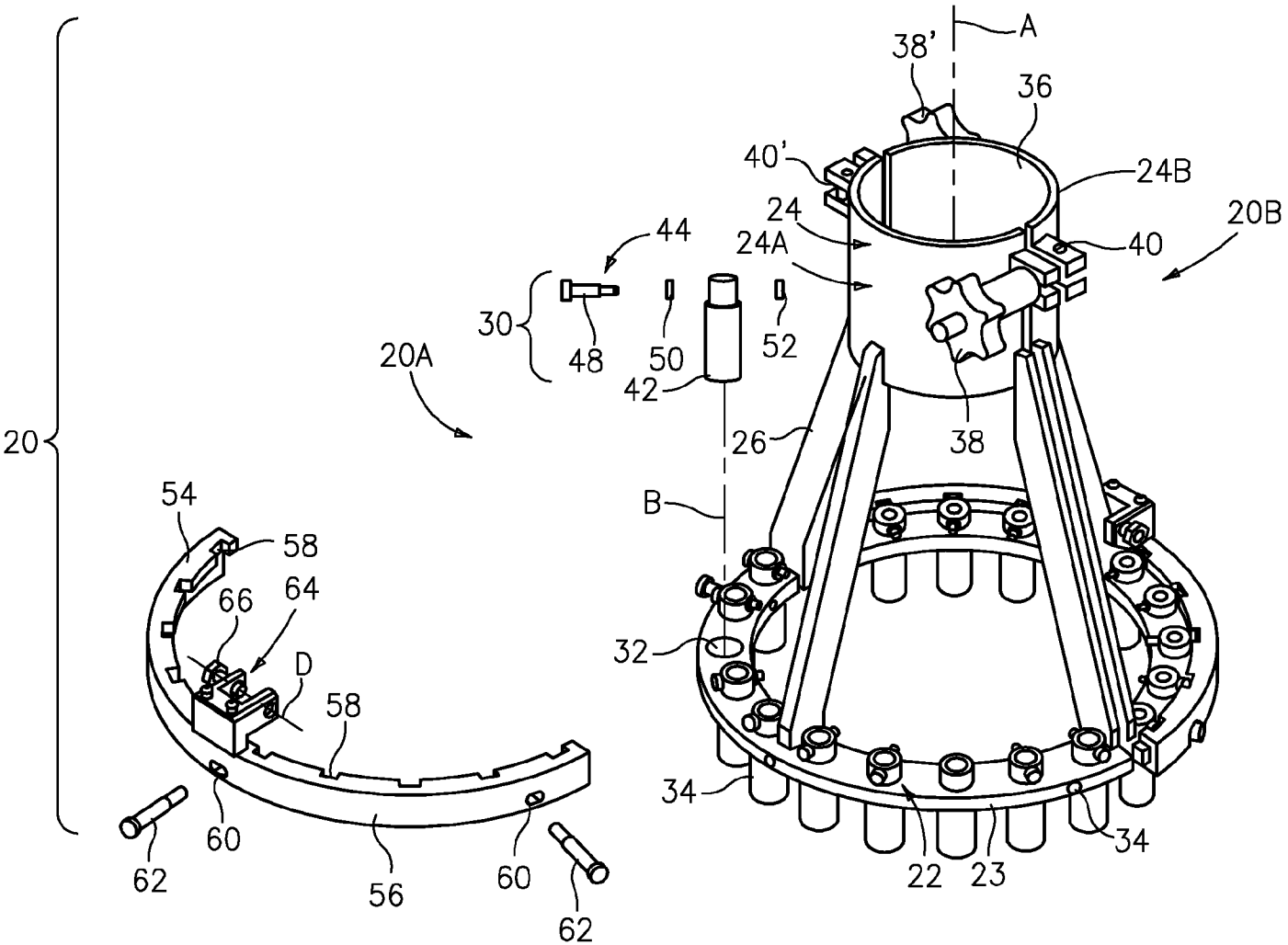
FIG. 3 is an exploded view of the tool.

Referring to FIG. 3, the base ring 22 includes a semi-circular ring section 22A, 22B with a multiple of bores 32 formed therethrough along a respective axis B generally parallel to axis A. The multiple of bores 32 are arranged at a radial and circumferential position to correspond with the bolt location on the component.

The base ring 22 also defines a multiple of threaded bores 34 defined along respective axes C generally transverse to axis A. The multiple of threaded bores 34 may be defined within an edge 23 of the base ring 22.

The base ring 22 is mounted to a support 24 by the multiple of arms 26 (three shown for tool section 20A). The arms 26 provide for a stand-off distance between the base ring 22 and the support 24. The support 24 may include cuff-like semi-circular support sections 24A, 24B. The support section 24A is attachable to the corresponding support section 24B with a threaded handle 38. The threaded handle 38 may be attached to the support section 24A to be received in a receiver 40 such as a fixed nut or other mount on the support section 24B. The support section 24B likewise includes a threaded handle 38' which is attached to the support section 24B to be received in a receiver 40' or other mount on the support section 24A. The tool 20 is thereby attached to a component such as the shaft S by locating each tool section 20A, 20B around the shaft C (FIG. 1) and threading each threaded handle 38, 38' into the corresponding receiver 40, 40'. The support 24 does not receive significant torque from the bolts and is used only to position and retain the tool 20 on the component as the tool 20 need often be mounted in a vertical position in which the base ring 22 is above the support 24 (FIG. 1).

The support 24 may include a non-metallic liner 36. The non-metallic liner may be manufactured of rubber, plastic or other material to prevent damage to the component upon which the tool 20 is supported and to provide further hold between the support 24 and the component.

Figure 4A:
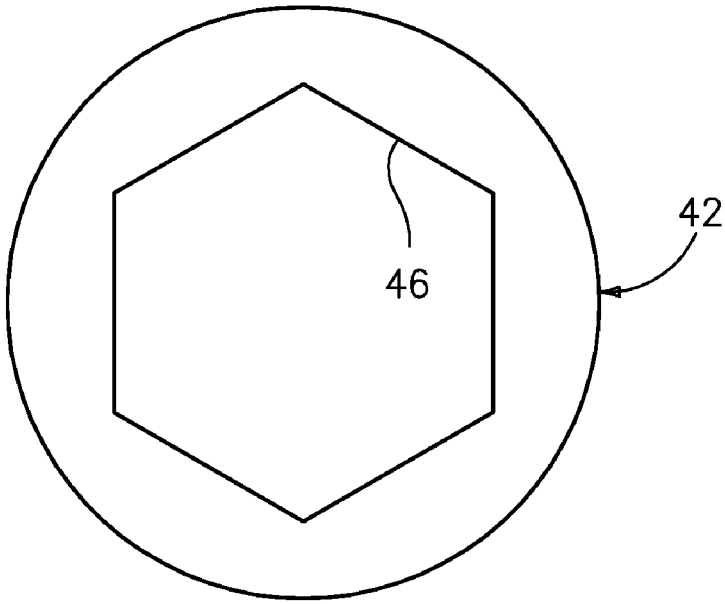
FIG. 4A is an end view of a socket geometry for the tool according to one non-limiting embodiment of the disclosure.
Figure 4B:
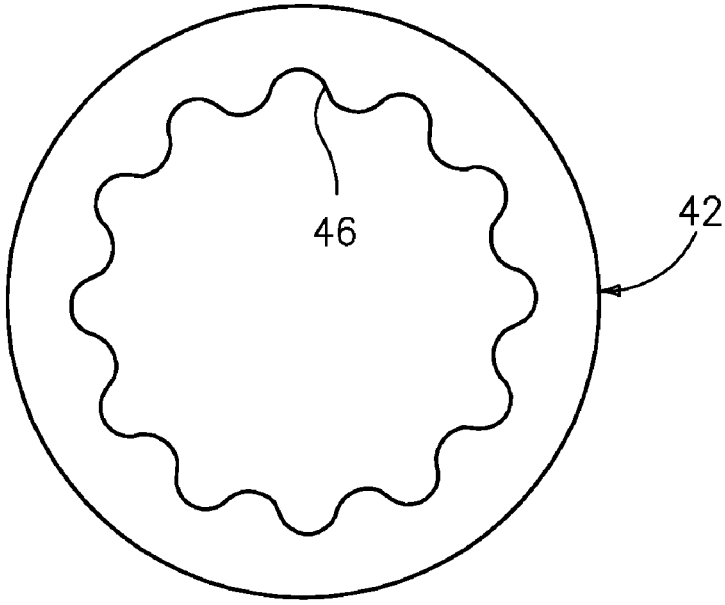
FIG. 4B is an end view of a socket geometry for the tool according to one non-limiting embodiment of the disclosure.

Each of the multiple of socket assemblies 30 includes a socket 42 and a transverse retainer 44 for rotational receipt within respective bores 32. The socket 42 includes an inner geometry 46 (FIGS. 4A and 4B) to engage the expected bolt head. That is, a polygonal, hexagonal or other geometry is located within the socket 42 to receive the bolt head and react torque applied thereto.

The transverse retainer 44 may be a bolt 48, washer 50 and nut 52 arranged through the socket 42. The transverse retainer 44 extends at least partially therefrom to define a cam surface and at least partially support socket 42 with each bore 32 for rotation therein.

The slide ring 28 includes a semi-circular slide ring section 28A that is generally L-shaped in cross-section having an upper surface 54 transverse to axis A and side surface 56 parallel to axis A. A multiple of slots 58 are arranged in the upper surface 54 of the slide ring section 28A to receive the retainer 44 at least partially therein. A multiple of slots 60 are arranged through the side surface 56 to correspond with the threaded bores 34 within the edge 23 of the base ring 22.

Fasteners 62 are mounted though each of the multiple of slots 60 to be received into threaded bores 34 within the edge 23 of the base ring 22. The slots 60 allow the slide ring section 28A the freedom to move relative to the base ring 22. In one non-limiting embodiment, the slide ring section 28A may move approximately +/−10 degrees circumferentially relative the base ring 22.

A fork attachment 64 extends from the slide ring section 28A in a circumferential position to capture one arm 26 therebetween. The fork attachment 64 supports a threaded retainer 66 along an axis D transverse to the arm 26 such that the retainer 66 may be threaded through the fork attachment 64 and impinge upon the arm 26.

By threading the retainer 66 into the fork attachment 64 such that that retainer 66 impinges on the arm 26, the slide ring section 28A will move relative to the base ring section 22A. The slide ring 28 thereby rotates all the socket assemblies 30 simultaneously through cam action. That is, the slide ring section 28A essentially biases all the socket assemblies 30 (in the direction illustrated schematically by arrow S) in response to movement of the slide ring section 28A (in the direction illustrated schematically by arrow R) relative to the base ring section 22A (FIG. 2). The slide ring section 28A thereby restrains all socket assemblies 30 while the bolts are torqued. Notably, slide ring section 28B may move in the same direction.

Once all the bolts are torqued, the combined torque essentially locks the tool 20 thereto through interaction with all the socket assemblies 30. To release this combined torque, retainer 66 is unthreaded to reduce impingement on arm 26. The slider ring 28 thereby releases the biases on all the socket assemblies 30 (in the opposite direction illustrated schematically by arrow s; FIG. 2) and thereby releases the combined torque. The tool 20 is then easily removed.

The tool 20 thereby functions to hold a multiple of bolts for torquing yet allows or quick and easy removal with greatly reduced effort. It should be understood that various sized tools may be useful in any situation where a multi-torque condition exists which would otherwise tend to lock-up due to large combined torques.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present invention.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A tool comprising:

a multiple of socket assemblies;

a base ring which defines a multiple of bores, each of said multiple of bores sized to receive one of said multiple of socket assemblies;

a slide ring mountable to said base ring to rotate said multiple of socket assemblies, said slider ring includes a fork attachment which captures one of a multiple of arms; and a support mounted to said base ring by said multiple of arms.

2. The tool as recited in claim 1, wherein said tool include two semi-circular tool sections.

3. The tool as recited in claim 1, wherein said base ring include two semi-circular base ring sections.

4. The tool as recited in claim 3, wherein said slide ring include two semi-circular slide ring sections.

5. The tool as recited in claim 4, wherein each of said slide ring sections may move approximately +/−10 degrees circumferentially relative to said respective base ring sections.

6. The tool as recited in claim 1, wherein said slide ring is mountable to said base ring to rotate said socket assemblies simultaneously through a cam action.

7. The tool as recited in claim 1, wherein each of said multiple of socket assemblies includes a socket and a transverse retainer.

8. The tool as recited in claim 7, wherein said socket includes an inner geometry.

9. The tool as recited in claim 8, wherein said inner geometry is polygonal.

10. The tool as recited in claim 1, wherein said slider ring is mountable to said base ring with a multiple of fasteners which extend through a respective slot in said slider ring.

11. A tool comprising:

a multiple of socket assemblies;

a base ring defined about an axis, said base ring which defines a multiple of bores, each of said multiple of bores sized to receive one of said multiple of socket assemblies;

a slide ring mountable to said base ring for rotation about said axis to rotate said multiple of socket assemblies;

a support defined about said axis, said support mounted to said base ring by a multiple of arms; and a fork attachment that extends from said slide ring to capture one of said multiple of arms.

* * * * *